US011150023B2

(12) United States Patent
Harasym

(10) Patent No.: US 11,150,023 B2
(45) Date of Patent: Oct. 19, 2021

(54) WIND TURBINE LANCE IGNITION SYSTEM

(71) Applicant: Michael F. Harasym, Phoenixville, PA (US)

(72) Inventor: Michael F. Harasym, Phoenixville, PA (US)

( * ) Notice: Subject to any disclaimer, the term of this patent is extended or adjusted under 35 U.S.C. 154(b) by 50 days.

(21) Appl. No.: 16/815,592

(22) Filed: Mar. 11, 2020

(65) Prior Publication Data

US 2020/0318907 A1 Oct. 8, 2020

Related U.S. Application Data

(60) Provisional application No. 62/830,065, filed on Apr. 5, 2019.

(51) Int. Cl.
*F27D 3/15* (2006.01)
*C21C 5/46* (2006.01)

(52) U.S. Cl.
CPC ..... *F27D 3/1527* (2013.01); *C21C 5/4606* (2013.01)

(58) Field of Classification Search
None
See application file for complete search history.

(56) References Cited

U.S. PATENT DOCUMENTS 4,450,986 A 5/1984 Harasym et al.
4,746,037 A 5/1988 Harasym
4,787,142 A 11/1988 Henderson et al.
4,877,161 A 10/1989 Harasym
5,544,695 A 8/1996 Harasym
7,537,723 B2 5/2009 Harasym
7,563,407 B2 7/2009 Harasym
2007/0290417 A1* 12/2007 Downie ..... E21B 7/146 266/44
2020/0318208 A1* 10/2020 Harasym ..... C21C 5/462
2020/0318906 A1* 10/2020 Harasym ..... F23D 14/60
2020/0318907 A1* 10/2020 Harasym ..... C21C 5/4653

* cited by examiner

*Primary Examiner* — Scott R Kastler

(74) *Attorney, Agent, or Firm* — Faegre Drinker Biddle & Reath LLP

(57) ABSTRACT

A telescoping thermal lance assembly including a housing with an oxygen inlet port. An extension tube disposed in the housing. The extension tube having a cylindrical interior cavity. The extension tube configured to slide at least partially out of the housing when pressurized oxygen is channeled into the inlet port. A cylindrical lance tube is located within the interior cavity of the extension tube and slides partially out of the extension tube when pressurized oxygen is channeled into the housing. A slice rod is located within the lance tube. A cap is attached to the top of the extension tube and spaced apart from the tip of the lance tube. A gas turbine assembly attached above the cap and including a turbine and a plurality of blades that rotationally drive the turbine, rotation of the turbine generating a spark in the igniter section.

4 Claims, 2 Drawing Sheets

WIND TURBINE LANCE IGNITION SYSTEM

RELATED APPLICATION

The present application is related to and claims priority from U.S. Provisional Application No. 62/830,065 filed Apr. 5, 2019, the disclosure of which is incorporated herein by reference in its entirety.

FIELD OF THE INVENTION

This invention is related to the general field of discharge ports on ladles, furnaces and tundishes, and more specifically to a thermal lance for unplugging a clogged molten metal vessel discharge port.

BACKGROUND

Discharge ports in molten metal dispensing systems at times can fail to open specifically upon an initial opening attempt, either through the clogging of the nozzle or tap hole fill material or hardened metal in the dispensing port, thereby inhibiting the flow of motel metal out of the vessel. The inventor of the instant application has developed several solutions over the years to assist in unclogging the plugged discharge port, including the inventions disclosed in U.S. Pat. Nos. 4,450,986; 4,746,037; 4,787,142; 4,877,161; 5,544,695; 7,537,723 and 7,563,407, the disclosures of which are incorporated herein by reference in their entirety.

In U.S. Pat. No. 4,450,986, a telescoping lance assembly includes a cylindrical housing that encloses a free-floating hollow metal tube. High pressure oxygen (on the order of 100 psi) is ported through the housing to propel the tube upwardly into the obstruction and to sustain burning as the combustible material is ignited. The tube is partially filled with magnesium wires or low carbon steel wires as the primary combustible material.

In U.S. Pat. No. 4,746,037, the telescoping lance assembly includes a flared bottom and a combustible collar at the top. The flared bottom is wider than the opening in a bushing located at the top of the housing to keep the tube from falling out of the housing. The tube is filled with magnesium wires or low carbon steel wires intertwined with steel wool to allow oxygen flow and to provide high surface area for combustion. The combustible collar includes a cardboard sheath wrapped around a low temperature blasting fuse and the exposed ends of the wires and steel wool. This construction provides a reliable ignition.

U.S. Pat. No. 4,877,161 discloses an improved lance assembly with a double telescoping mode to provide greater extension into a deep discharge port without the need for elongating the housing. The lance assembly includes a cylindrical housing with a port to admit pressurized oxygen. Inside the housing is either one or two free floating tubes. The tube (when single) or the uppermost tube (when dual) contains combustible magnesium or low carbon steel wires as the combustible material. The tube is crimped into the wires at the top and bottom of the tube to prevent the wires from moving forward or backward inside the tube. The tips of the wire extend out of the top end of the tube and they may be capped with an igniter covered by tape.

In another prior art lance assembly, the telescoping tube is made of stainless steel to provide a lower rate of consumption than the more combustible material of the thermal lance inside of it. The tube may have a flared base or a base flange to keep it centered in the housing, and the housing may include a bushing near the top end to prevent the tube from completely exiting the housing. The combustible material of the lance is a combination of thin cylindrical rod made of low carbon sheet metal that is roll-formed into a cylindrical rod that allows oxygen to flow axially through the rod. Rods of this type, and the process of making them, are described in U.S. Pat. No. 4,787,142. They are used as electrodes in exothermal cutting of metal and are commonly called burning bars or slice rods. They can be obtained from welding supply distributors under the brand name ARCAIR. The axial oxygen flow and increased surface area as compared to a solid bar or a hollow tubular bar provide for a rapid ignition and for burning in the presence of high temperature and oxygen flow.

The rod is surrounded by a low carbon steel sheath to provide greater rigidity and more mass of combustible low carbon steel. The sheath has an inner bore slightly greater than the outer diameter of the rod and an outer diameter less than the inner diameter of the stainless steel tube. The rod extends about ¾ inch to 1½ inches beyond the end of the sheath and several inches out of the opposite end. One end of the sheath is welded to the rod where the longer end of the rod extends such that the rod and sheath move together as a combustible lance within the telescoping tube. The top end of the tube can be crimped and filled with a steel wool (not shown) and can include a low temperature blasting fuse. This lance design provides greater combustible mass and more rigidity than the prior lances filled with steel or magnesium wires.

U.S. Pat. No. 7,563,407 discloses an improved thermal lance tip on a lance assembly. The lance assembly includes an outer low carbon steel sheath having an inner diameter. An inner rod is disposed in a sheath having an internal bore and a thin cylindrical rod that is roll-formed from low carbon steel sheet. The rod is sized for conforming fit in the bore of the tube and has a length dimension that is longer than the length of the tube. The rod is inserted into the bore of the tube and allowed to move axially within the tube under propulsion of the pressurized oxygen to allow the rod to be burned at a rate independent of the burn rate of the sheath. One or more apertures in the tube restrict the flow of oxygen until the rod is ignited. An 0 ring located near the fuse protector of the lance housing keeps the lance from moving during routine handling and storage.

The existing thermal lances can, at times, be difficult to ignite. A need exists for an improved thermal lance that facilitates ignition.

SUMMARY OF THE INVENTION

A telescoping thermal lance assembly is disclosed for use in unplugging a vessel discharge port. The telescoping thermal lance assembly includes a housing with an upper end that has an opening. An oxygen inlet port is located on the housing spaced apart from the open end. The oxygen inlet port is configured to connect to a supply of pressurized oxygen.

A cylindrical extension tube is disposed within the housing and extends partially out through the opening in the upper end of the housing. The extension tube has an open top and a closed bottom opposite the open top with a sidewall extending between the open top and the closed bottom. The extension tube has an inner diameter defining a cylindrical interior cavity, and an aperture extending through the sidewall or the closed bottom for permitting a flow of oxygen to enter into the interior cavity. The extension tube is slidingly disposed within the housing and configured to slide at least partially out of the opening in the upper end of the housing when a supply of pressurized oxygen is channeled into the inlet port.

The assembly includes an elongated cylindrical hollow lance tube made from a combustible material. The lance tube has an axial length with first and second ends. The lance tube has a cylindrical sidewall defined by an outer wall having an outer diameter and an inner wall having an inner diameter. The sidewall has a wall thickness between the outer and inner walls. The lance tube has a longitudinal axis. The lance tube being is slidingly disposed within the interior cavity of the extension tube and configured to slide at least partially out of the open top of the extension tube when a supply of pressurized oxygen is channeled into the aperture.

A slice rod is located within the inner wall of the lance tube. The slice rod being formed from low carbon steel.

A cap is attached to the open top of the extension tube, spaced apart from the tip of the lance tube. The space below the cap and above the tip of the lance tube defines an igniter section.

A gas turbine assembly is attached above the cap. The gas turbine assembly includes a turbine and a plurality of blades attached to the turbine and configured to rotationally drive the turbine. The blades are positioned so as to receive a stream of pressurized gas from a hole in the cap. The gas turbine assembly include two insulated copper wires, each wire having one end electrically connected to an associated terminal on the turbine, and an opposite end attached to a respective end of a light gauge steel wire located in the igniter section. When the blades rotate, they rotate the turbine so as to produce electrical current to flow through the copper wire. The electrical current causes the steel wire to spark or burn.

Preferably there is an upper housing mounted to the top of the housing or the extension tube. The upper housing includes walls configured to channel the stream of pressurized gas toward the blades.

The upper housing may include at least one opening for permitting the pressurized gas to vent out of the upper housing. The upper housing optionally includes one or more louvers covering the opening in the upper housing for inhibiting debris from entering the upper housing.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of the illustrating the invention, the drawings show a form of the invention which is presently preferred. However, it should be understood that this invention is not limited to the precise arrangements and instrumentalities shown in the drawings.

DISCLOSURE OF THE INVENTION

Figure 1:
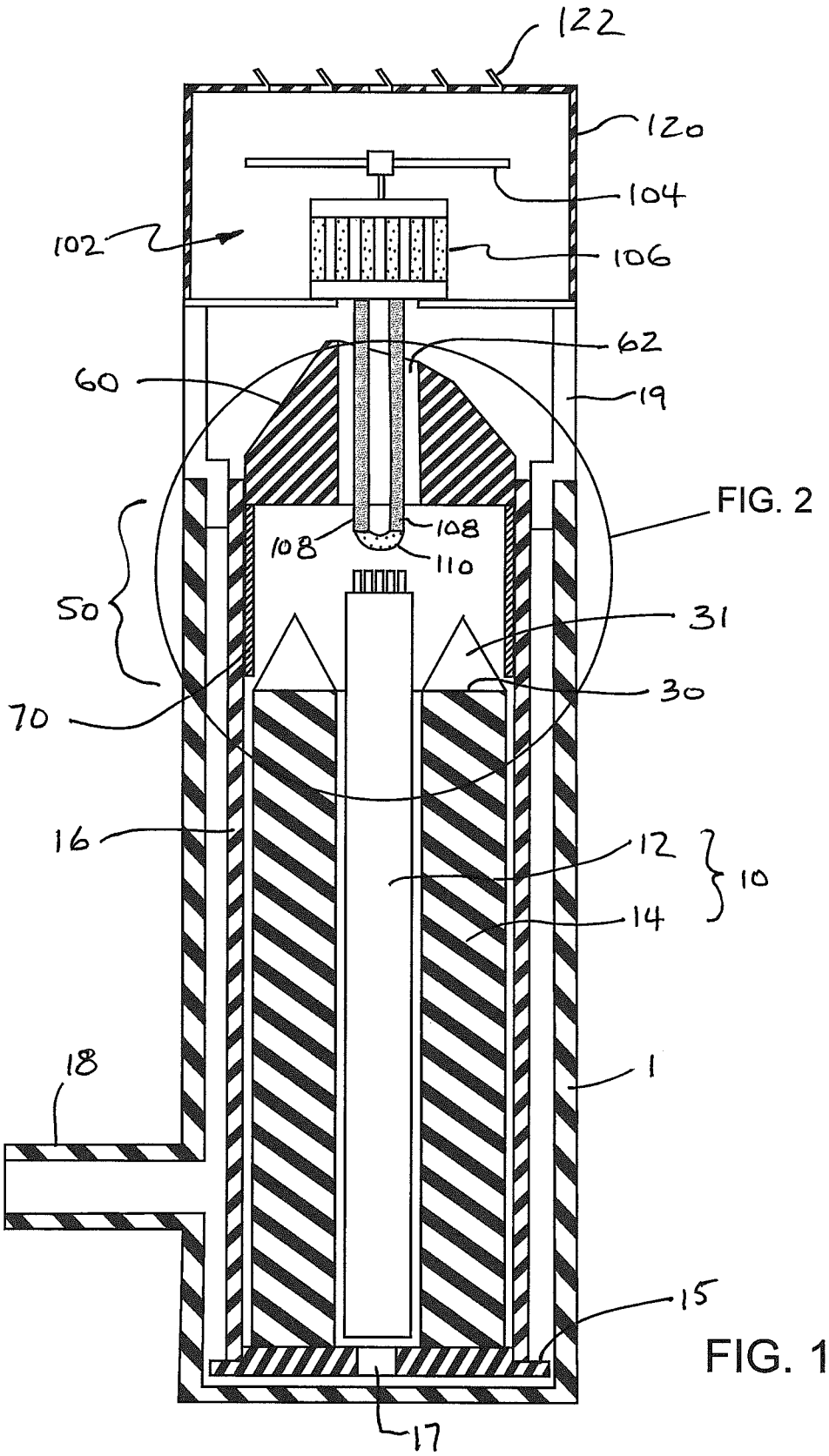
FIG. 1 is a side cross-sectional view of a thermal assembly with a wind turbine ignition system according to the present invention.

The present invention relates to an improved thermal lance for unplugging a vessel discharge port, for example, in a refractory lined ladle. As shown in FIG. 1, an inner lance assembly 10 includes a tubular thermal lance or tube 14 with a lance rod 12, commonly called a burning bar or slice rod, disposed within the lance tube 14. The inner lance assembly 10 is located within an axially displaceable extension tube 16 which is located within the interior of a housing 1 to form a telescoping thermal lance assembly. The extension tube 16 may have a flared base or a base flange 15 (FIG. 2) to keep it centered in the housing 1, and the housing may include a bushing 19 near the top end to prevent the extension tube 16 from completely exiting the housing 1. The bottom of the tube 16 has an aperture 17 to allow oxygen to flow into the tube.

As noted above, the inner lance assembly 10 (lance tube 14 and lance rod 12) and tube 16 are disposed within the outer housing 1. A conduit 18 communicates pressurized oxygen to the interior of the housing 1. When the apparatus is placed in line with an obstructed discharge port and an oxygen supply is opened, the oxygen flows through the conduit 18 and into the housing 1 raising the axially displaceable extension tube 16 toward the obstruction in the discharge port. Oxygen flows around and into the interior or the raised tube 16 through aperture 15 to facilitate rapid burning upon ignition in the vicinity of the obstruction, as is well known in the field.

As extension tube 16 telescopes out of housing 1, lance tube 14 telescopes out of the tube 16. In addition, lance rod 12 telescopes out of lance tube 14. The telescoping extension tube 16 is preferably made of stainless steel or other high carbon steel to provide a lower rate of consumption than the more combustible material of the thermal rod 12 and lance tube 14 which are located inside extension tube 16. As tube 16 slides upward, the base flange 15 contacts the bushing 19 at the uppermost end of the housing 1 thereby preventing the extension tube 16 from exiting the housing 1.

As discussed above, the combustible lance assembly 10 includes tube 14 and lance rod 12, both made of low carbon steel formed into a cylindrical rod that has substantial mass and surface area, yet allows oxygen to flow axially between and through the lance tube 14 and lance rod 12. The axial oxygen flow and increased surface area provide rapid ignition and burning in the presence of high temperature molten metal and oxygen flow.

A tip 30 of the lance tube 14 is located below the top of the tube 16. The tip of the lance tube 14 may be formed with one or more protrusions extending upward (in the illustrated embodiment) from the end of the lance tube 14. The protrusions 31 facilitate ignition of the thermal lance assembly. The details on the lance tube and the protrusions are described in co-pending U.S. patent application Ser. No. 16/815,525 titled "Tip Protrusions On Lance Ignition Tube", filed concurrently herewith, the disclosure of which is incorporated herein by reference in its entirety. An igniter section 50 is defined between the tip 30 and the bottom of a cap bullet tip 60 attached to the top of the tube 16. Steel wool (not shown) or other porous combustible material is located in the igniter section 50. It is also contemplated that volatile material, including liquids, solids, or semi-solids could be added to the igniter section 50 to facilitate ignition. The outer diameter of the lance tube 14 is less than the inner diameter of the extension tube 16, thus leaving a gap between the lance tube 14 and the extension tube 16 defining a passageway 40 through which oxygen can flow. The lance tube 14 includes an inner bore 22 containing the slice or lance rod 12 which is also designed for oxygen to flow through to the igniter section 50. Slice rods, and the process of making them, are described in U.S. Pat. No. 4,787,142.

It is also contemplated that a tubular blow-out preventer sleeve 70 may be incorporated into the igniter section 50 above the tip 30 of the lance tube 14 inside the extension tube 16. The sleeve 70 is preferably made from stainless steel, carbon steel or combustible material. The sleeve 70 provides the ignition zone 50 with increased protection against blowout. Details on the sleeve 70 are provided in co-pending U.S. patent application Ser. No. 16/815,537 titled "Lance With Blowout Preventer, Oxygen Flow Reducer And Improved Ignition System", filed concurrently herewith, the disclosure of which is incorporated herein by reference in its entirety.

Figure 2:
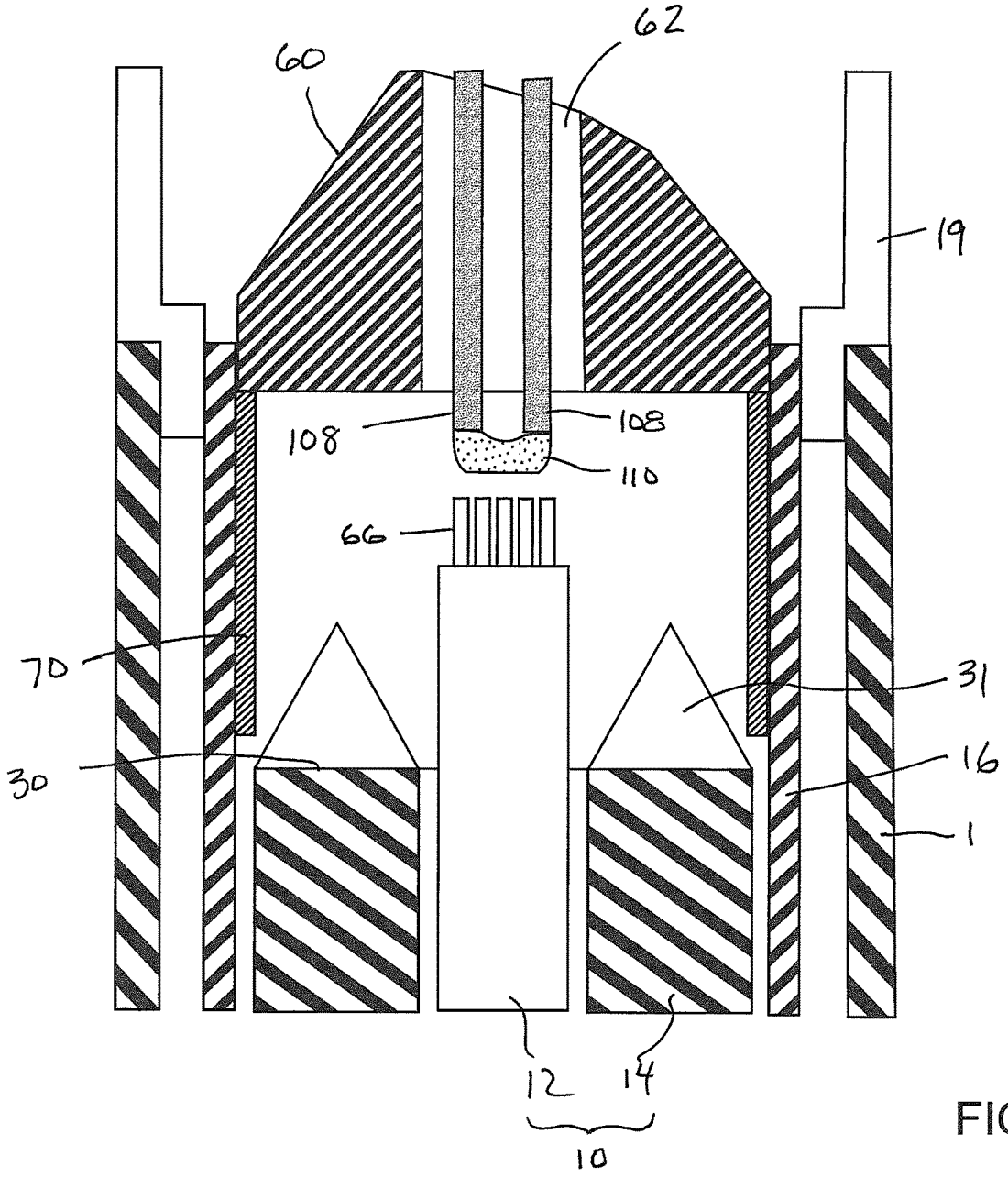
FIG. 2 is an enlarged view of a portion of the thermal lance assembly of FIG. 1

The cap 60 includes a hole 62. Instead of using a conventional low temperature blasting fuse for ignition, the present invention incorporates a novel gas driven igniter. A gas turbine assembly 102 is mounted above the bullet tip 60. The gas turbine assembly 102 includes blades or vanes 104 that are positioned above and rotationally drive a turbine 106. Two insulated copper wires 108 are electrically connected to two terminals of the turbine 106. Referring to FIG. 2, which is an enlarged view of a portion of FIG. 1, the wires 108 extend downward through the hole 62 in the bullet tip 60. A lower end of each wire is electrically connected to a light gauge insulated steel wire 110 inside the igniter section 50.

During use, oxygen in channeled into the housing 1 through port 18 and into extension tube 16. The oxygen flows through the inner lance assembly 10 (including slice rod 12 and lance rod 14). The oxygen then flows out through the hole 62 in the bullet tip 60. As the pressurized oxygen passes the blades 104, it causes the blades 104 to rotate, thereby rotating the turbine 106. Rotation of the turbine 106, in turn, causes electrical current to flow through the copper wire 108. When the electrical current reaches the insulated steel wire 110, it shorts out creating a spark or burns out creating enough heat to ignite the combustible material in the igniter section, thereby igniting the thermal lance assembly.

An upper housing 120 could be mounted to the top of the bushing retainer 19 to channel the oxygen to the blades 104. Louvers 122 could be mounted to the outlet on the upper housing 120 to prevent debris from dropping onto the turbine assembly 102. While louvers 122 are shown, other mechanisms for preventing debris from entering the upper housing 120 can be incorporated. Those skilled in the art would be readily capable of incorporating such alternate mechanisms based on the teaching disclosed in this specification. One such alternative would be to add oxygen exhaust openings along the vertical length of housing 120 and replace the louvered cap 122 with a solid cap.

As used herein, the term "engage" is intended to both direct physical engagement through one or more components as well as operative engagement.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

The use of directions, such as forward, rearward, top and bottom, upper and lower are with reference to the embodiments shown in the drawings and, thus, should not be taken as restrictive. Reversing or flipping the embodiments in the drawings would, of course, result in consistent reversal or flipping of the terminology.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalent.

The invention claimed is:

1. A telescoping thermal lance assembly for use in unplugging a vessel discharge port, the telescoping thermal lance assembly comprising:

a housing with an upper end that has an opening, and an oxygen inlet port located on the housing spaced apart from the upper end, the oxygen inlet port configured to connect to a supply of pressurized oxygen;

a cylindrical extension tube disposed in the housing and extending partially out through the opening of the upper end of the housing, the extension tube having an open top and a closed bottom opposite the open top with a sidewall extending between the open top and the closed bottom, the extension tube having an inner diameter defining a cylindrical interior cavity, and an aperture extending through the sidewall or the closed bottom for permitting a flow of oxygen to enter into the interior cavity, the extension tube being slidingly disposed within the housing and configured to slide at least partially out of the opening in the upper end of the housing when a supply of pressurized oxygen is channeled into the inlet port;

an elongated cylindrical hollow lance tube made from a combustible material, the lance tube having an axial length with first and second ends, the lance tube having a cylindrical sidewall defined by an outer wall having an outer diameter and an inner wall having an inner diameter, and the sidewall has a wall thickness between the outer and inner walls, the lance tube having a longitudinal axis, the lance tube being slidingly disposed within the interior cavity of the extension tube and configured to slide at least partially out of the open top of the extension tube when a supply of pressurized oxygen is channeled into the aperture;

a slice rod located within the inner wall of the lance tube, the slice rod being formed from low carbon steel;

a cap attached to the open top of the extension tube, the cap located spaced apart from the tip of the lance tube, the space below the cap and above the tip of the lance tube defining an igniter section;

a gas turbine assembly attached above the cap, the gas turbine assembly including a turbine and a plurality of blades attached to the turbine and configured to rotationally drive the turbine, the blades being positioned so as to receive a stream of pressurized gas from a hole in the cap, the gas turbine assembly having two insulated copper wires, each wire having one end electrically connected to an associated terminal on the turbine, and an opposite end attached to a respective end of a light gauge steel wire located in the igniter section, wherein the stream of pressurized gas causes the blades to rotate, thereby rotating the turbine so as to produce electrical current to flow through the copper wire, the electrical current causing the steel wire to spark or burn.

2. The telescoping thermal lance assembly of claim 1 further comprising an upper housing mounted to the top of the housing or the extension tube, the upper housing including walls configured to channel the stream of pressurized gas toward the blades.

3. The telescoping thermal lance assembly of claim 2 wherein the upper housing includes at least one opening for permitting the pressurized gas to vent out of the upper housing.

4. The telescoping thermal lance assembly of claim 3 wherein the upper housing includes one or more louvers covering the opening in the upper housing for inhibiting debris from entering the upper housing.

* * * * *